US006904727B2

(12) United States Patent
Edger

(10) Patent No.: US 6,904,727 B2
(45) Date of Patent: Jun. 14, 2005

(54) BASEMENT WINDOW SYSTEM

(75) Inventor: Ronal Fredrick Edger, Bolton (CA)

(73) Assignee: Royal Group Technologies Limited, Ontario (CA)

( * ) Notice: Subject to any disclaimer, the term of this patent is extended or adjusted under 35 U.S.C. 154(b) by 261 days.

(21) Appl. No.: 09/916,434

(22) Filed: Jul. 30, 2001

(65) Prior Publication Data

US 2002/0011038 A1 Jan. 31, 2002

(30) Foreign Application Priority Data

Jul. 31, 2000 (CA) ..... 2314793

(51) Int. Cl.[7] ..... E06B 1/04

(52) U.S. Cl. ..... 52/215; 52/204.5; 52/204.54; 52/204.53; 52/208; 52/211; 52/212; 52/213; 52/656.2; 52/775; 52/776; 52/780

(58) Field of Search ..... 52/204.54, 215, 52/656.2, 204.53, 208, 211–213, 775, 776, 780; 264/154, 31–35, 294, 299, DIG. 64

(56) References Cited

U.S. PATENT DOCUMENTS 1,640,595 A * 8/1927 Buss ..... 25/131
1,881,971 A * 10/1932 Roedig ..... 25/131
2,787,820 A * 4/1957 Shields ..... 25/131
2,893,235 A * 7/1959 Goldberg ..... 25/131
2,901,810 A * 9/1959 Richards ..... 25/131
3,220,079 A * 11/1965 Aggson ..... 25/118
3,769,769 A * 11/1973 Kohl ..... 52/212
3,835,586 A * 9/1974 Gates et al. ..... 249/39
3,995,843 A * 12/1976 Kasteler ..... 249/39
4,138,084 A * 2/1979 Reid ..... 249/177
4,430,831 A * 2/1984 Kemp ..... 249/39
4,589,624 A * 5/1986 Jones ..... 249/177
4,831,781 A * 5/1989 Morton ..... 292/251.5
5,003,747 A * 4/1991 Morton ..... 52/209
5,169,544 A * 12/1992 Stanfill et al. ..... 249/22
5,319,884 A * 6/1994 Bergeron ..... 49/466
5,369,922 A * 12/1994 Hansen ..... 52/204.54
5,729,942 A * 3/1998 Moore, Jr. ..... 52/204.2
5,791,103 A * 8/1998 Coolman et al. ..... 249/134
5,843,323 A * 12/1998 Ranard ..... 249/39
5,996,293 A * 12/1999 Anderson et al. ..... 249/39
6,067,754 A * 5/2000 Bellart ..... 49/453
6,185,884 B1 * 2/2001 Myers et al. ..... 249/177

FOREIGN PATENT DOCUMENTS

DE 199 92 172 A1 1/1999

* cited by examiner

*Primary Examiner*—Carl D. Friedman
*Assistant Examiner*—Christy M. Green

(57) ABSTRACT

Installation of a basement window system by assembling the window system between a pair of novel window forms releasably secured thereto. This assembly is maintained during the erection of the foundation wall into which the window system is incorporated and the erection of above grade wall after which the window forms are removed.

14 Claims, 8 Drawing Sheets

3
3
10'
4
1
4

BASEMENT WINDOW SYSTEM

FIELD OF THE INVENTION

This invention relates to a method of installing a basement window system and to the forms for use in such installation.

BACKGROUND OF THE INVENTION

In the erection of a concrete foundation of a building which includes the provision for basement window systems, it is very difficult to install and protect the window system against damage during the pouring of the concrete foundation wall and the subsequent erection of the above grade wall and exterior treatment. Such damage includes breaking of the glass where the windows are left in the frame of the system as well as distortion of the frame. Thus failure to fully protect the window system throughout the erection procedure can lead to costly retrofits including window replacements.

To date there has been no easy or reliable low cost answer to this problem and it is the object of the present invention to provide a very simple and low cost solution which will ensure integrity of the window system during both the erection of the concrete foundation and the above grade walls and exterior treatment.

SUMMARY OF THE INVENTION

In installing the window system, the frame of the system, which can have its windows in place, is first secured against potential damages during the construction activity between a pair of releasably attached preformed window forms which precisely cover opposite faces of the system and into which fasteners can be driven for mounting the assembled window system and forms between the foundation wall forms.

In accordance with the preferred form of the invention, the window forms are molded plastic members.

A basement window system in widespread use is a 3¼ inch system in which the sides of the frame are provided with grooves for accessory attachments.

For such standard window systems according to the preferred form of the invention, the window forms interconnect with the grooves of the frame of the window system for accurate location and as well are adhesively secured to the system's frame. For handling prior to installation, the assembled window system and window forms are preferably strapped together, the straps, of course, being removed at the job site when ready for installation.

When ready for use, the strapping is removed and this window assembly, i.e. the window system which as noted by virtue of the invention can include the windows mounted in the frame of the system and the window forms, is then located in position between the foundation wall forms with the upper edge of the assembled window and window forms substantially flush with the top of the wall forms. This window and window forms assembly is held in position by clamps or by fasteners driven through the foundation wall forms and into the window forms. The transverse width of the assembled window and window forms at their periphery is such as to span between the foundation wall forms.

Following installation, concrete is poured around the frame of the window system and the periphery of the sandwiching window forms until the concrete is flush with the top of the wall forms. Then, after the concrete has set, the foundation wall forms are removed.

Next the above grade wall is erected. This wall may, for example, be brick with the bricks then laid over the top of the assembled window and window forms following which, and any other exterior wall treatment, the releasable window forms are removed from the window frame leaving the window system installed and totally free from damage.

In another aspect, the invention also involves the provision of novel, low cost forms for protecting the window system during erection of the building.

In this connection, each window form is of molded composite plastic material having a peripheral wall which tapers inwardly from an outer border flange to an inner mounting flange parallel to the border flange. The peripheral wall and inner flange support a window covering platform into which fasteners can be driven disposed within the outer flange and lying just inwardly of the outer surface of the outer flange. The platform is reinforced by a series of intersecting reinforcing webs on its underside.

The plastic material from which the window form is molded is preferably a composite material comprising particles of recycled filler material bound together by recycled thermoplastic material.

As such, these window forms upon being damaged constitute recyclable material for use in producing new forms so that the forms never need to be discarded thus reducing the costs and adding to the efficiency of the system.

Again, according to the preferred form of the invention, the inner flange of the window form has a thin web projecting perpendicular thereto around the perimeter thereof. This web or wall forms a peripheral bayonet wall for insertion into grooves, i.e. the accessory grooves, around the perimeter of the frame of the window system to ensure accurate registration of the form and the window system throughout the entire operation from delivery of the window system sandwiched between the forms until removal upon the erection of the above grade walls and any exterior treatment. Further, according to a preferred form of the invention, border openings are provided around the perimeter of the platform of the window form to enable the form to be easily gripped for removal.

It will also be understood that such forms will be of light weight for handling adding to the facility with which the installation can be made.

DETAILED DESCRIPTION ACCORDING TO THE PREFERRED EMBODIMENTS OF THE PRESENT INVENTION

Figure 1:
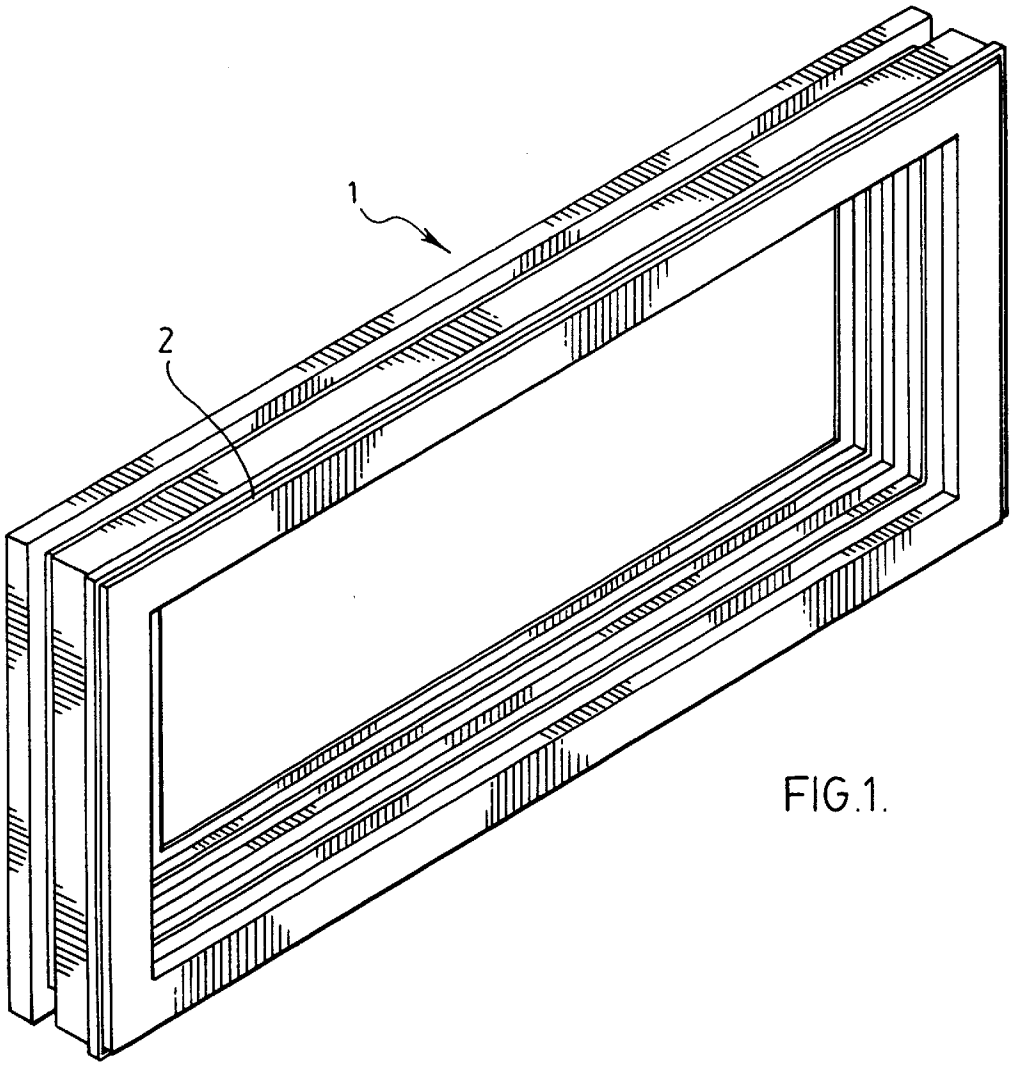
FIG. 1 is a perspective view of the frame of a conventional basement window system, for example, a standard 3¼ inch window system with accessory grooves to be installed in a foundation wall, the windows of the system having been removed from the frame for ease of illustration.

FIG. 1 is a perspective view of a frame 1 of a standard 3¼ inch window system having a peripheral accessory groove 2 on each face thereof which system is to be installed in the foundation wall of a building.

It will be understood that frame 1 carries the windows of the window system which for simplicity of illustration are not shown. While, of course, frame 1 can be installed without the windows being present, the invention allows the window system to be safely installed with the windows mounted in the frame.

Figures 2, 3:
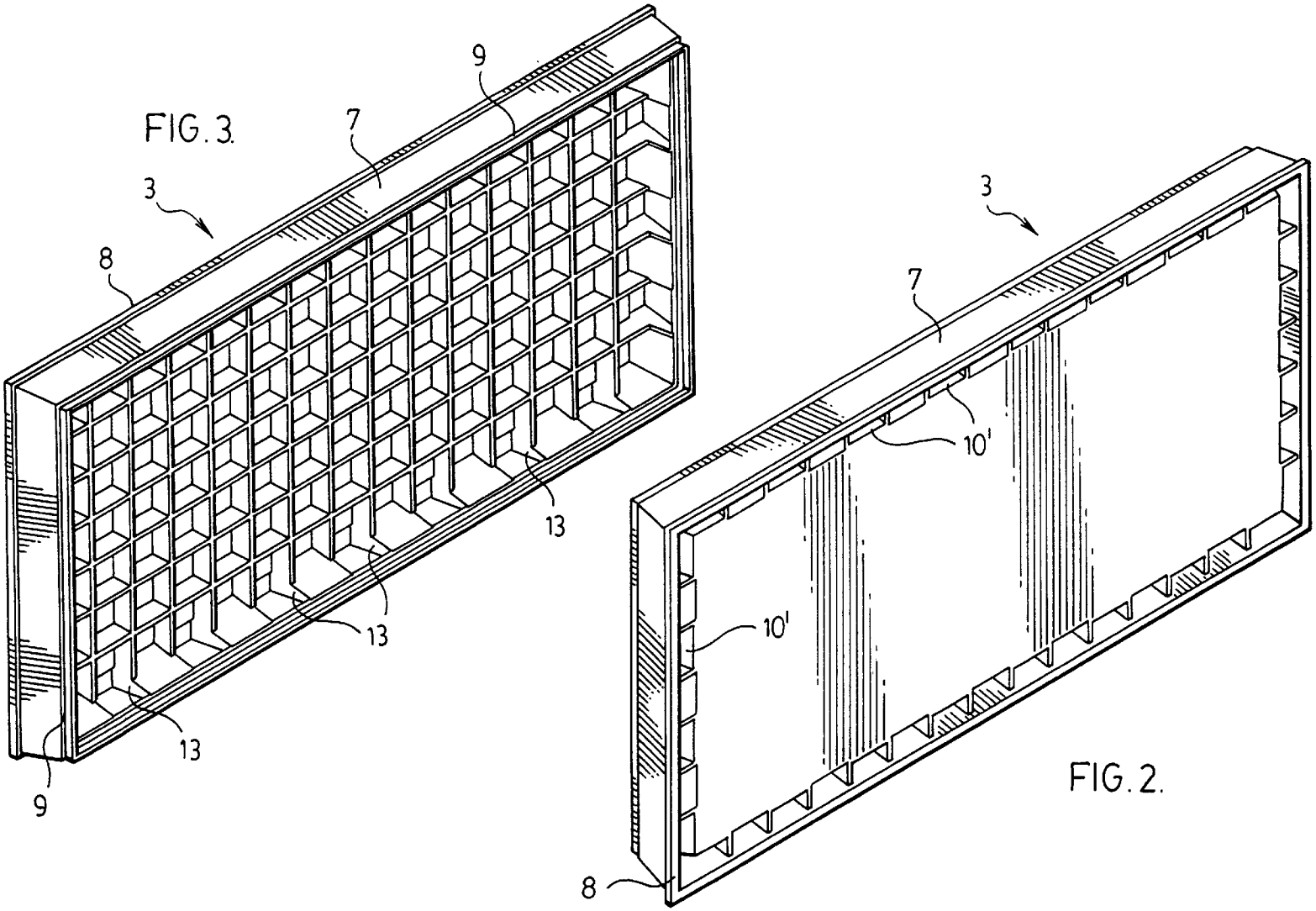
FIG. 2 is a perspective view showing the outside or front face of a window form to be used in installing the window system of FIG. 1 in accordance with the invention.
FIG. 3 is a perspective view showing the inner or rear face of the window form of FIG. 2.

FIGS. 2 and 3 illustrate the front and rear of one of the window forms 3 used to protect the window system during installation.

Figure 4:
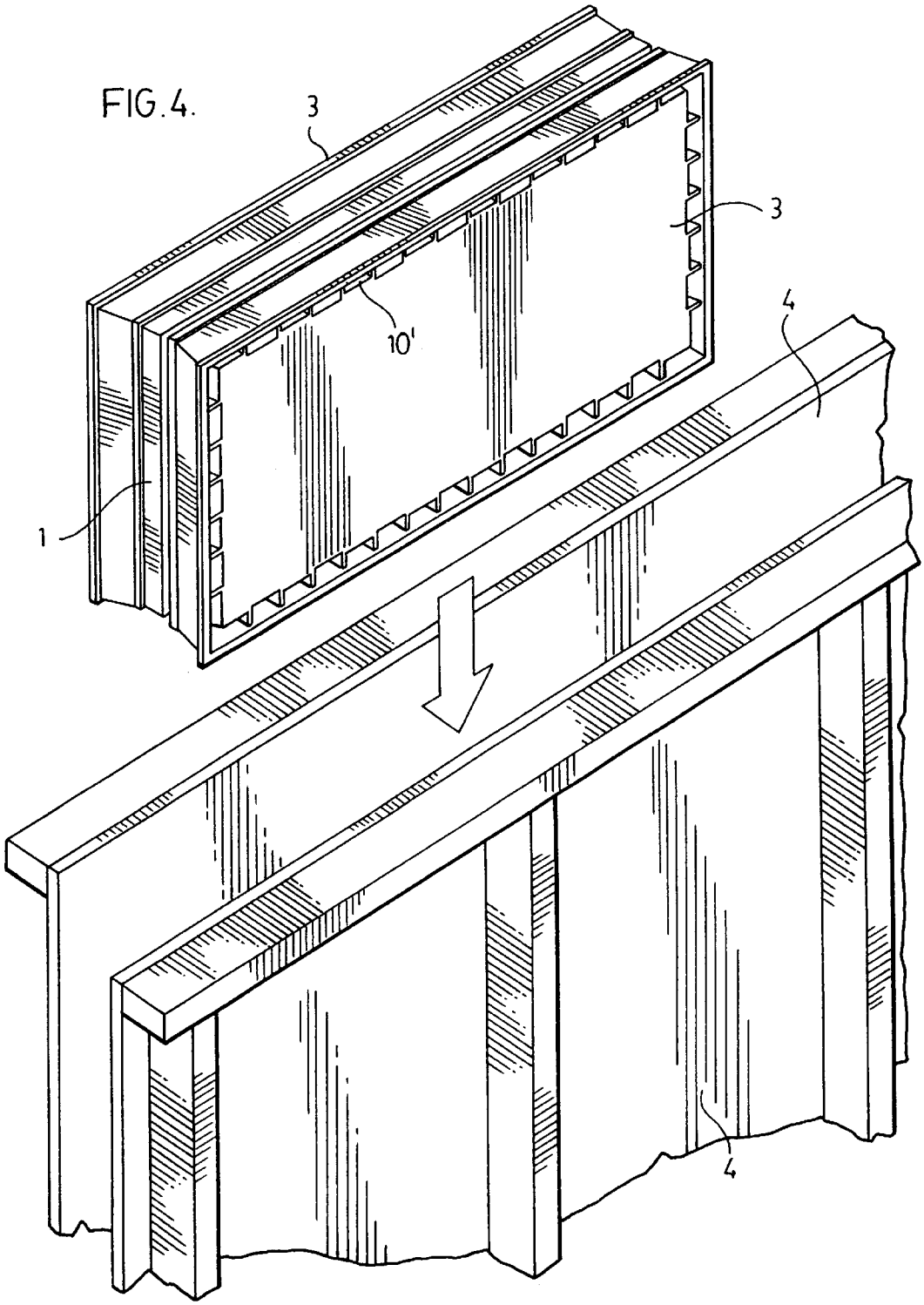
FIG. 4 shows the window system frame of FIG. 1, which by virtue of the invention can safely include the windows of the system during installation assembled between a pair of the window forms of FIGS. 2 and 3 which are releasably secured to the frame, the assembly being readied to be inserted between spaced foundation wall forms as a first step in the installation of the window system.

As a first step, the window frame 1, preferably with its window in place, is assembled between a pair of window forms 3 as shown in FIG. 4 for mounting between the foundation wall forms 4.

Figure 5:
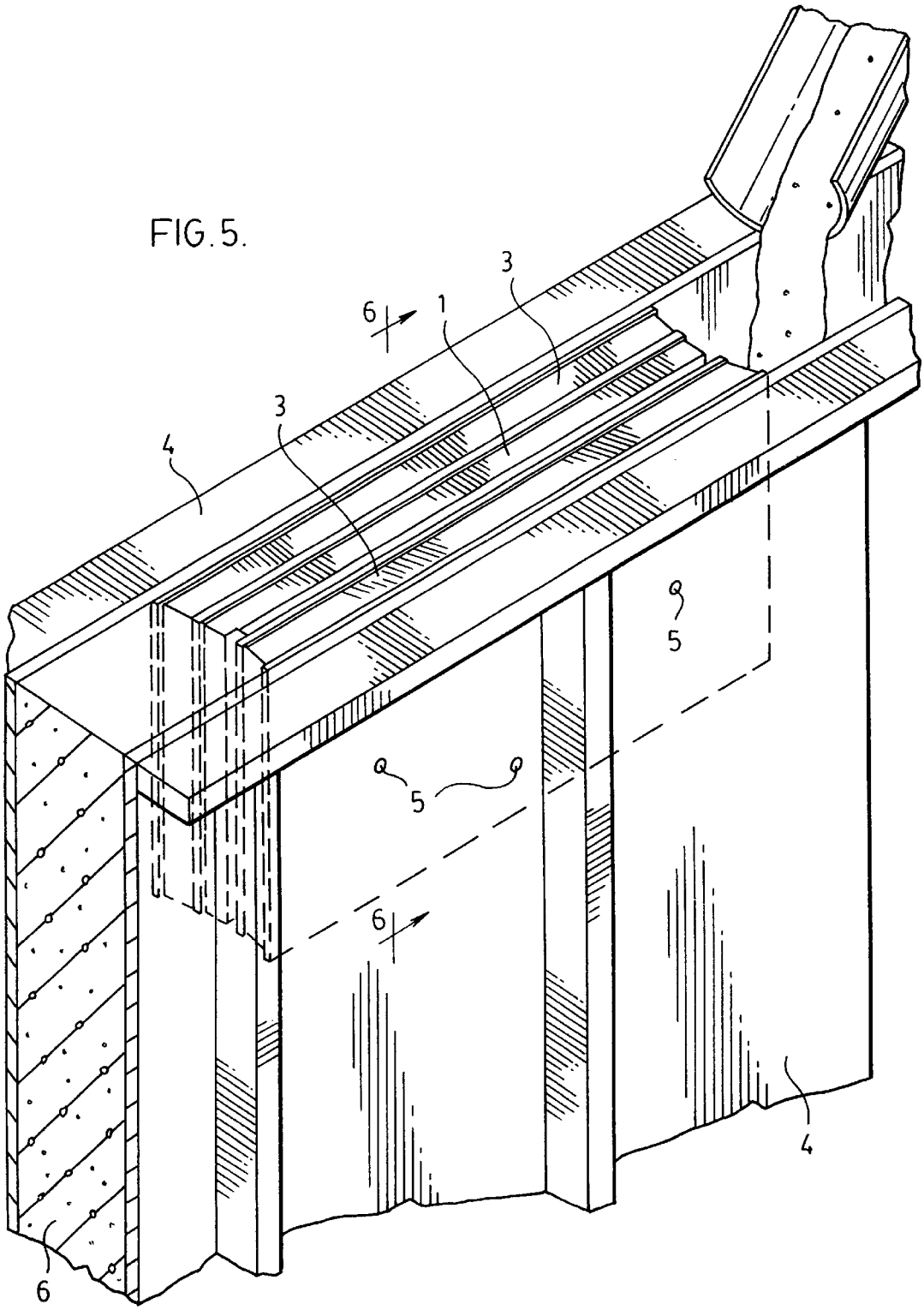
FIG. 5 is a perspective view showing the second step of the installation in which the assembled window frame and window forms are secured between the foundation wall forms with the top of the assembly being substantially flush with the top of the foundation forms and showing the concrete being introduced into the foundation forms.

FIG. 5 shows the assembled frame and window forms 1 and 3 respectively mounted in position between the foundation wall forms 4 by fasteners 5 driven through the wall forms into the window forms with the upper surface of the assembly substantially flush with the top of the wall forms and showing concrete 6 being introduced between the wall forms to flow around the perimeter of the window frame and forms assembly that projects down into the foundation wall forms 4. As will be apparent, the window forms 3 into which the fasteners 5 are driven totally cover and protect any window mounted in the frame 1.

Each of the window forms 3 is molded from a suitable plastic material and is formed with a peripheral wall 7 having a short outturned border flange 8 at its outer side and an inturned flange 9 at its inner side.

Extending outwardly from the inner flange 9 to a point just inside the flange 8 are a series of spaced wall sections 10 which taper inwardly of the peripheral wall 7 and support a front face plate 11 just inwardly of the outer flange 8. The spacing between the wall sections 10 leave openings 10' by means of which the face plate 11 can be easily gripped to facilitate removal of the forms.

The face plate 11 is reinforced with a grid work of intersecting webs or walls 12 with those of the webs 12 which fall between the wall sections 10 being connected with the peripheral wall 7 as indicated at 13.

Figure 6:
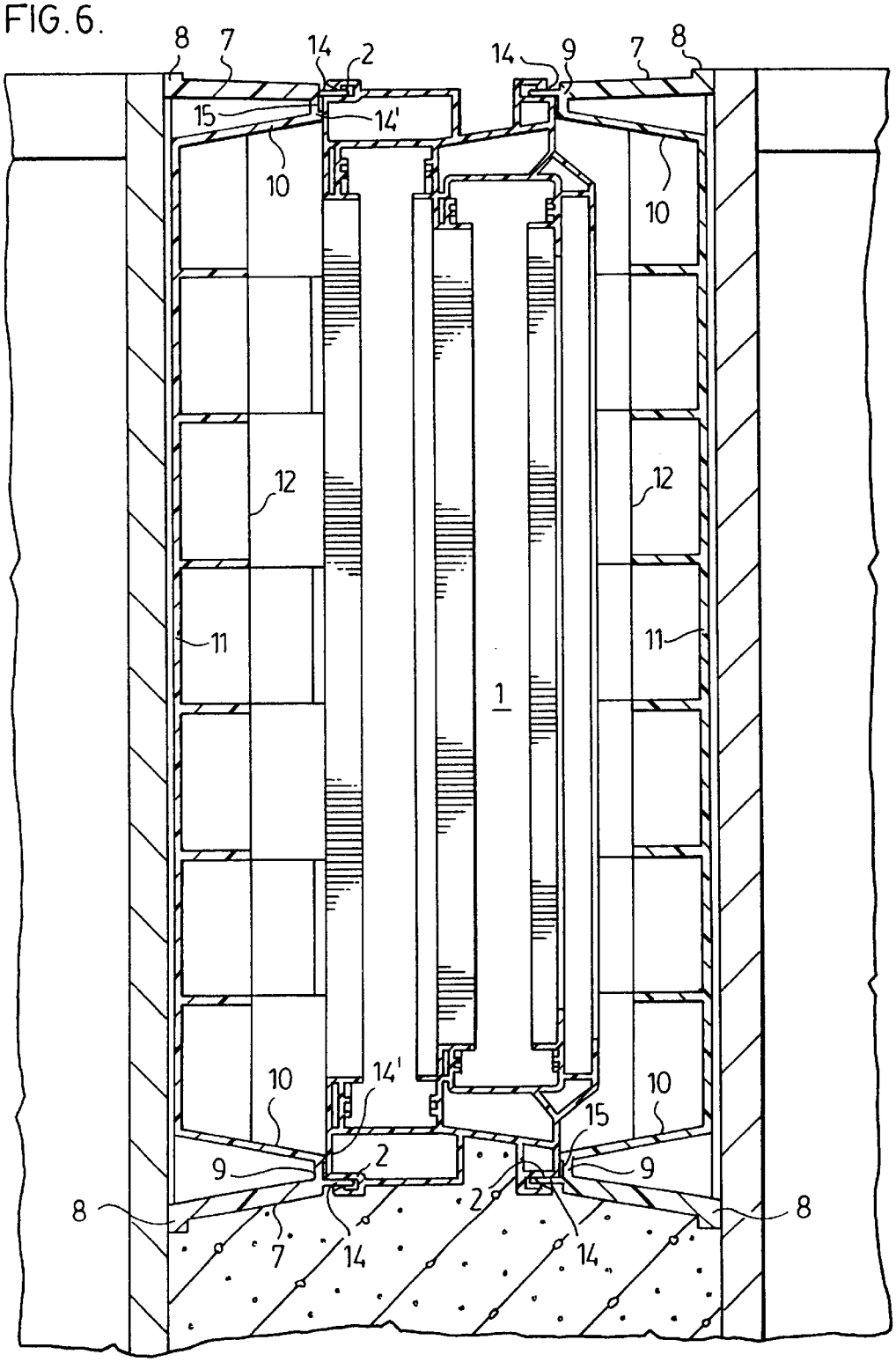
FIG. 6 is a vertical sectional view through the assembled window frame and window forms mounted between the foundation wall forms after the concrete has been poured into the foundation wall forms.

Projecting perpendicularly inwardly from the inner flange 9 is a thin web or wall 14 which, in effect, comprises a peripheral bayonet wall for projecting into the accessory groove 2 on the respective sides of the frame 1 as illustrated in FIG. 6.

The inner flange 9 is also provided with a very short stub projection 14' disposed inwardly of the bayonet wall 14 to maintain a space 15 between the flange 9 and the side of the frame 1 to receive a suitable adhesive to adhesively yet releasably secure the form 3 to the frame 1.

In this connection, the window forms 3 are releasably secured to the frame 1 by a suitable adhesive placed in the space 15 between the flanges 9 of the forms 3 and the sides of the frame 1 with the bayonet walls 14 inserted into the accessory grooves 2 to provide accurate registration of the window forms with the frame.

The peripheral walls 7 of the window forms, at least in the ends and the bottoms of the forms which come in contact with the concrete 6, are sloped inwardly from the outer flange 8 to the inner flange 9 to facilitate their ultimate removal.

It will be understood that the combined width of the frame 1 and the window forms 3 at the periphery thereof will span the space between the wall forms 4 so that the concrete will only flow around the sides and bottom of the window frame and forms assembly.

Following setting of the concrete 6, the wall forms 4 are removed leaving the releasably attached window forms 3 assembled with the frame 1 secured in the foundation wall 16.

Figure 7:
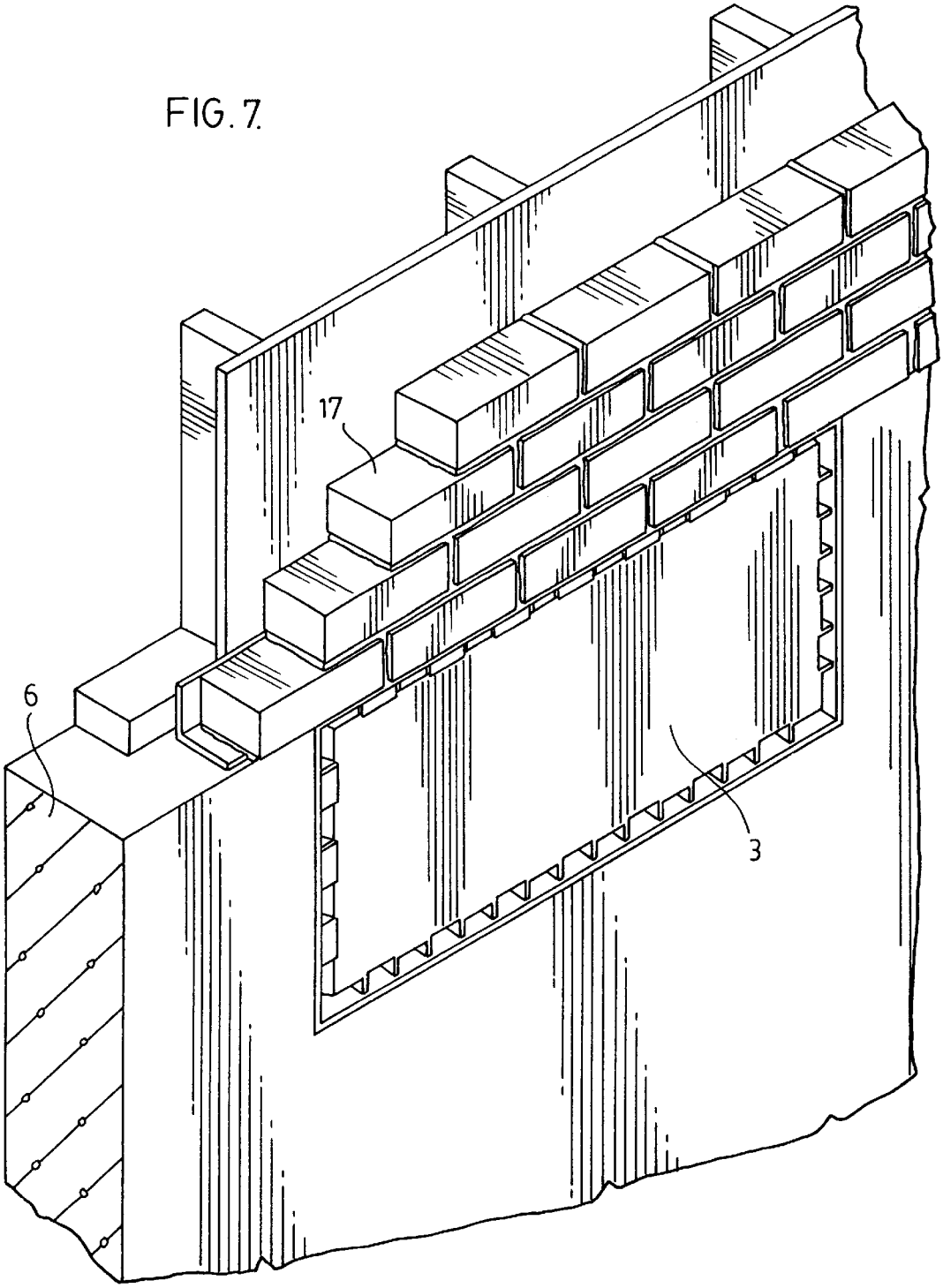
FIG. 7 is a perspective view showing the next step of the installation in which the foundation wall forms have been removed and the above grade wall is being installed over the assembled window frame and window forms.

Next the above grade wall shown as a brick wall 17 is erected over the assembled window frame and forms as shown in FIG. 7.

Figure 8:
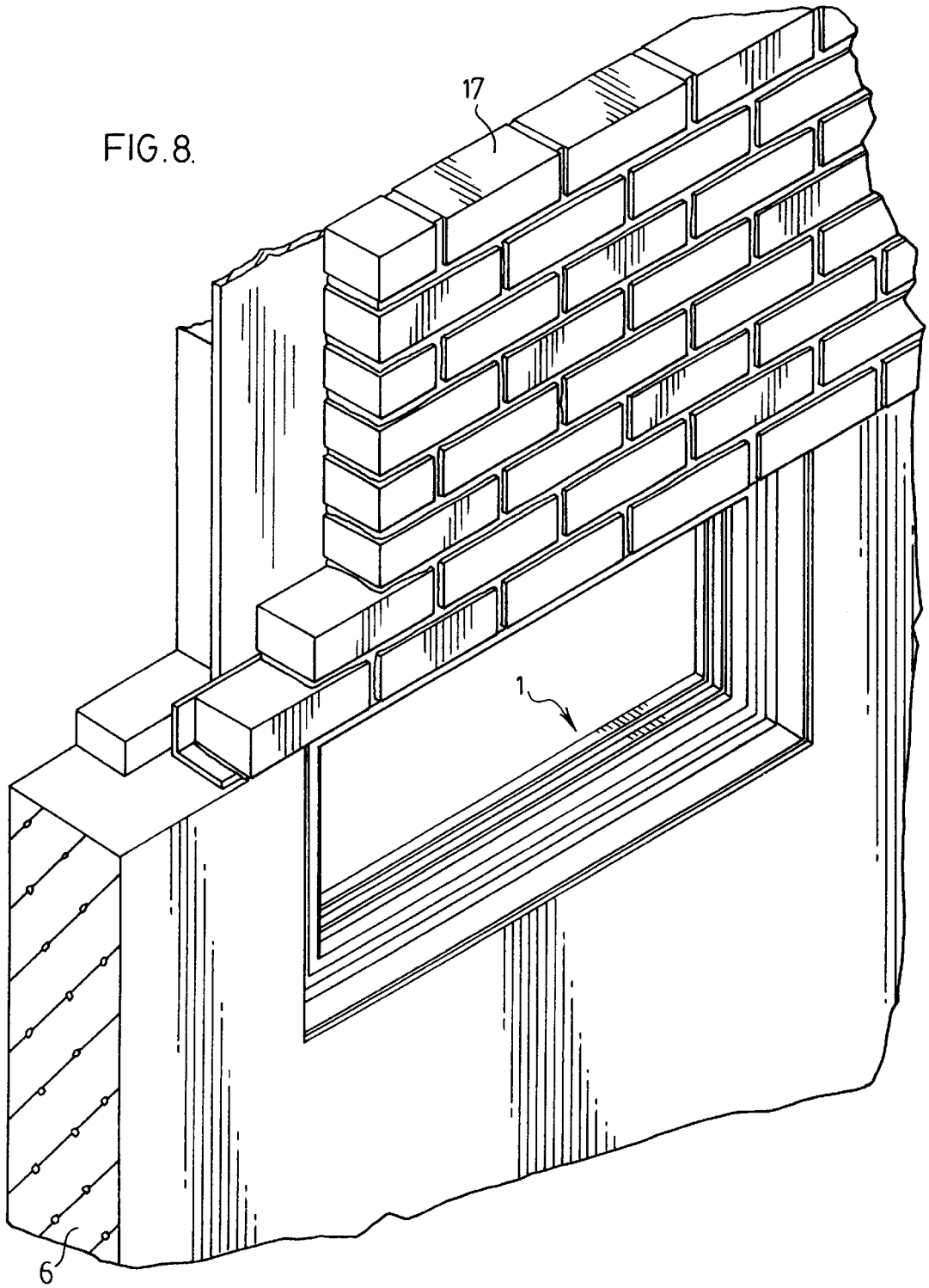
FIG. 8 is a view similar to FIG. 7 but showing the window forms removed from the window frame.

After the erection of the above grade wall 17, the window forms 3 are removed, for example, by gripping their plate portions 11 through the openings 10' and pulling them away from the window frame to complete the installation as illustrated in FIG. 8.

Figure 10:
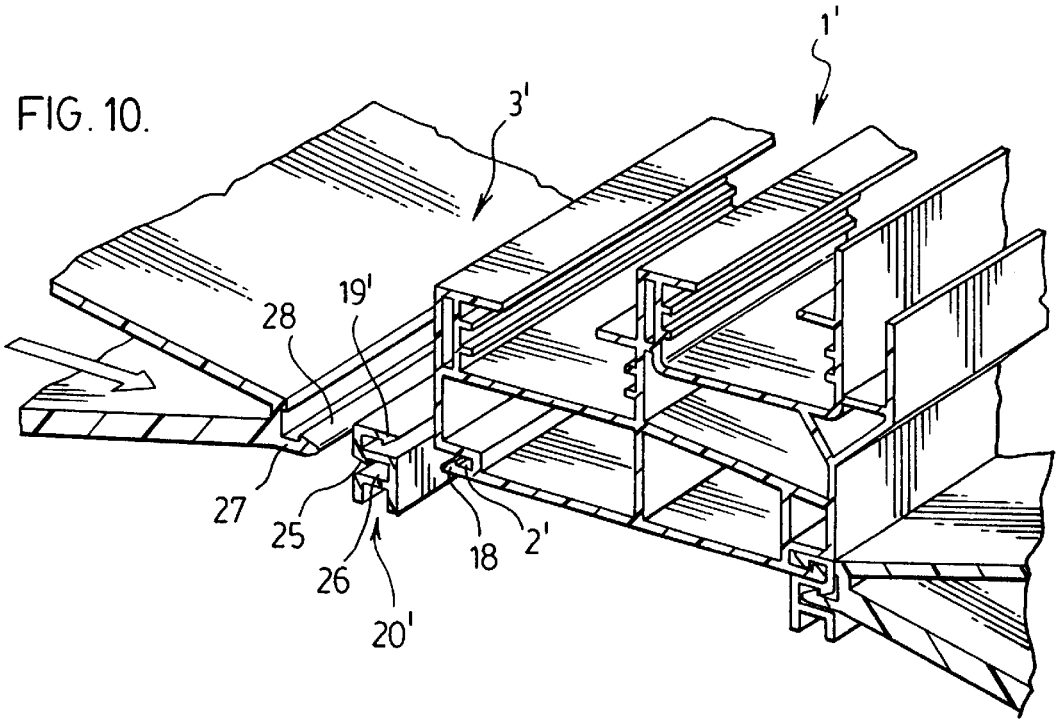
FIG. 10 is a view similar to FIG. 9 but showing a slightly modified window form which snap locks with the adapters as well as being adhesively secured thereto.
Figure 9:
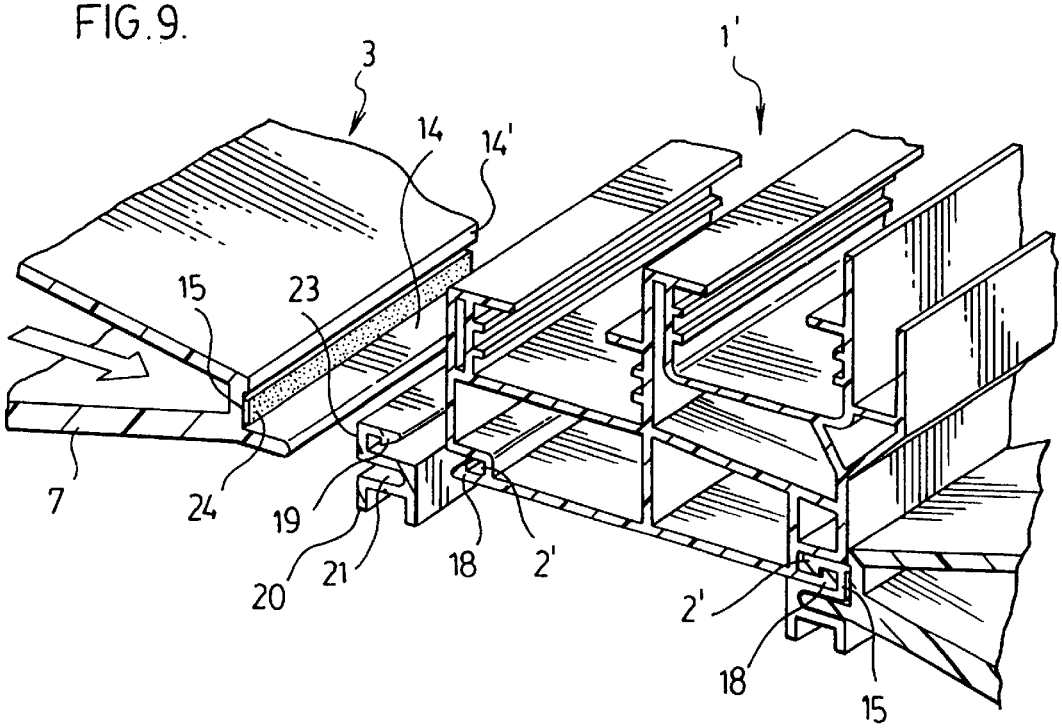
FIG. 9 is an enlarged broken away perspective view showing the use of an extruded adapter which snap locks with the window frame grooves and to which the window forms are adhered to interconnect between the window frame and the window forms.

FIG. 6 shows the bayonet wall 14 of the window forms inserted directly into the accessory grooves 2 of the window frame with the close fit between these bayonet walls and the grooves 2 and the adhesive in the space 15' providing the releasable connection therebetween. FIGS. 9 and 10 show alternative arrangements for releasably securing the window forms 3 to the frame 1.

With reference to FIG. 9, it will be seen that the grooves 2' of the window frame 1' are provided with an inwardly sloping latching lip or ledge 18 for interlocking engagement with a corresponding latching lip or edge 19 of an extruded adapter 20 having a groove 21 to receive the bayonet edge 14 of the window form 3. The window form 3 is then releasably secured to the surface 22 of adapter 20 by means of a band of adhesive 24 introduced into the space 15 between the bayonet edge 14 and the projection 14'.

In the modified arrangement of FIG. 10, the window frame 1' is as described with respect to FIG. 9 but the adapter 20' in addition to having the latching edge 19' corresponding to the latching edge 19 of adapter 20 also has an interned latching lip or edge 25 in the channel 26 into which the window form 3' is to be inserted. In the case of FIG. 10, the window forms 3' instead of having a simply bayonet edge are formed with bayonet walls 27 which have a rearwardly inclined latching lip or edge 28 to interlock with the lip 25 of the adapter 20' to provide one releasable interconnection between the forms 3' and the adapters 20'. Additional releasable securement between the forms 3' and the adapters 20' may be obtained by again providing adhesive between the forms and the frame in the manner as illustrated in FIG. 9.

The wall forms 3 or 3' are preferably molded from a composite plastic material comprising a mixture of thermoplastic particles and particles of waste or filler material. The plastic may, for example, be recycled thermoplastic in the form of reground low, medium or high density polyethylene, polypropylene, polyethethylene terephthalate, or PVC. The waste or filler particles may, for example, comprise sawdust, ground wood pieces, ground cloth, paper, shells, husks or other particulate material. The ratio of thermoplastic material to filler material in the composite material can vary over a substantial range with the recycled thermoplastic varying from about seventy percent to thirty percent and the filler material from about thirty percent to seventy percent depending on the materials used.

In the event that the window forms 3 or 3' become damaged after extended use or through accident or otherwise, they can be returned for recycling to be used as material in the molding of new forms.

While the use of molded forms of plastic material as described significantly add to the facility of assembling the window frame and the window forms and to provide very cost effective forms both from the standpoint of the original production through molding and, as well, through the fact that they are recyclable, it will be understood that other window forms may be employed so long as they can be accurately registered with the window frame and releasably secured thereto and provide a cover over the faces of the frame into which fasteners can be driven and when introduced between the foundation wall forms will span the space therebetween.

It will be understood that various other modifications may be made without departing from the scope of the appended claims.

The embodiments of the invention in which an exclusive property or privilege is claimed are defined as follows:

1. A method of installing a window system having a window retaining frame in a foundation wall to be formed by pouring concrete between spaced foundation wall forms, said method comprising assembling said window frame between a pair of window forms by releasably securing one of said window forms to each side of said frame, each said window form having a peripheral wall extending laterally of said frame at the periphery thereof whereby said assembled frame and window forms have a peripheral thickness to span the space between said foundation wall forms and each said window form having at its outer side a wall adapted to receive fasteners driven thereinto covering one side of said frame, lowering said assembled frame and window forms between said foundation wall forms to a desired position and then securing same in said position by driving fasteners through said wall forms into said window form walls, then pouring concrete into said foundation wall forms to form the foundation wall and to flow around at least a major portion of the periphery of said assembled frame and window forms, then removing said foundation forms giving access to said releaseably secured window forms for the removal thereof.

2. A method as claimed in claim 1 in which said window frame is rectangular and has a peripheral groove on each side thereof and said window forms are of molded plastic material and are provided on their inner sides with projecting peripheral bayonet walls to fit into said peripheral frame grooves and the step of said method of assembling said window frame and window forms comprises the insertion of said window form peripheral bayonet walls into said frame grooves.

3. A method of installing a window system having a rectangular window retaining frame in a foundation wall to be formed by pouring concrete between spaced foundation wall forms; said method comprising assembling said window frame between a pair of rectangular window forms each having perimeteral dimensions corresponding to those of said frame by releasably securing one of said window forms to each side of said frame, each of said window forms having a peripheral wall extending laterally of said frame whereby said assembled frame and window forms have a peripheral thickness to span the space between said foundation wall forms and each said window form having at its outer side a wall into which fasteners can be driven and which covers one side of said frame, lowering said assembled window frame and window forms between said wall forms and then securing said assembled rectangular frame and window forms between said wall forms with one side of said frame adjacent to and substantially parallel with the top of said wall forms, pouring concrete into said foundation wall forms to form the foundation wall and to flow around said assembled frame and window forms to the top of said wall forms, then erecting an above grade wall over said foundation wall and said assembled frame and window forms, then removing said releasable secured window forms from said frame.

4. A method as claimed in claim 3 in which said assembled frame and window forms are secured between said wall forms by fasteners driven through said wall forms into the walls of said window forms which cover the sides of said frame.

5. A method as claimed in claim 3 in which said frame has peripheral grooves on each side thereof and said window forms are of molded plastic material and said peripheral walls of said window forms have peripheral bayonet walls projecting therefrom at their inner edges, and said step of assembling said window frame and said window forms comprises inserting said window form bayonet walls into said frame grooves to accurately register said window forms with said frame.

6. A method as claimed in claim 5 in which an adhesive is applied between said window forms and said frame in the step of assembling said frame and said window forms.

7. A method as claimed in claim 5 in which said window form wall which covers one side and said frame leaves openings around its perimeter and said window forms are removed by engaging same through said openings to withdraw said window forms.

8. A molded plastic window form configured to engage and support one side of a window frame inserted between spaced wall forms, said window form having a rectangular configuration with a perimeter wall having an upper section and a lower section joined at their ends by side sections, said perimeter wall having an outturned flange extending around its edge at its outer side and an inturned window frame engaging flange extending around its edge at its inner side with said flanges being parallel and with said wall tapering inwardly from said outer flange to said inner flange at least in said side and lower sections, and a rectangular face plate adapted to receive fasteners driven thereinto through a wall form disposed within said perimeter wall and substantially flush with said flanged outer edge, said plate having an area substantially equal to the area bounded by said perimeter wall and substantially closing the outer side of said form, said plate being supported by connections with said inner flange and being reinforced by a grid work of intersecting webs on the inner side thereof, said webs being connected to the inside of said perimeter wall.

9. A molded plastic window form as claimed in claim 8 having a window frame engaging bayonet wall projecting inwardly from said inner flange.

10. A molded plastic window form as claimed in claim 8 in which said plate connections with said inner flanges comprises spaced support walls extending outwardly from said inner flange and tapering inwardly of said perimeter wall with the spacing between said spaced support walls providing finger grip openings around said plate.

11. A molded plastic window form as claimed in claim 10 in which said grid work of intersecting webs comprises one set of webs extending between and connected to the insides of one pair of opposing peripheral walls and another set of webs extending between and connected to the inside of the other pair of peripheral walls, said web connections being located between said spaced support walls.

12. An integrally molded plastic window form configured to fit against and support one side of a window frame inserted between spaced wall forms, said window form having a peripheral wall whose perimeter matches the perimeter of the window frame against which said window form is to fit, said peripheral wall having a window frame engaging inner side and an outer side, and having at its outer side a fastener accepting formation for accepting fasteners driven trough a wall form, said fastener accepting formation being integrally connected to said peripheral wall, and comprising a plate portion having a planar outer face disposed substantially flush with the outer side of said peripheral wall, said plate portion having an area substantially equal to the area bounded by said peripheral wall and substantially closing the outer side of said form.

13. A molded plastic window form as claimed in claim 12 in which the inner side of said peripheral wall has a window frame engaging peripheral bayonet projection.

14. The method as claimed in claim 1 including the further step of erecting an above grade wall over said foundation wall and said assembled frame and window forms, and then removing said releasably secured window forms from said window frame.

* * * * *

UNITED STATES PATENT AND TRADEMARK OFFICE

CERTIFICATE OF CORRECTION

PATENT NO. : 6,904,727 B2
DATED : June 14, 2005
INVENTOR(S) : Ronal Fredrick Edger It is certified that error appears in the above-identified patent and that said Letters Patent is hereby corrected as shown below:

Title page,
Item [75], Inventors, should read -- Ronald Fredrick Edger, Bolton, Ontario (CA) and Stephen K. Jones, London, Ontario (CA) --.
Item [73], Assignees, should read -- Royal Group Technologies Limited, Ontario (CA) and Andersen Corporation, Minnesota, USA --.

Signed and Sealed this

Seventh Day of February, 2006

JON W. DUDAS
*Director of the United States Patent and Trademark Office*